US006581336B2

(12) United States Patent
Anttalainen et al.

(10) Patent No.: US 6,581,336 B2
(45) Date of Patent: Jun. 24, 2003

(54) WASTE WATER COLLECTION ARRANGEMENT

(75) Inventors: Timo Anttalainen, Masku (FI); Raimo Astikainen, Helsinki (FI); Pentti Koskela, Masku (FI); Ilkka Seppä , Turku (FI); Veikko Laisi, Vantaa (FI); Pertti Päätalo, Turku (FI); Rauno Virtanen, Turku (FI)

(73) Assignee: Kvaerner Masa-Yards Oy, Helsinki (FI)

( * ) Notice: Subject to any disclaimer, the term of this patent is extended or adjusted under 35 U.S.C. 154(b) by 0 days.

(21) Appl. No.: 09/898,689

(22) Filed: Jul. 2, 2001

(65) Prior Publication Data

US 2002/0043032 A1 Apr. 18, 2002

(30) Foreign Application Priority Data

Jul. 3, 2000 (FI) ..... 20001585

(51) Int. Cl.[7] ..... A47K 3/16
(52) U.S. Cl. ..... 52/34; 52/168
(58) Field of Search ..... 52/34, 168, 192, 52/197, 234, 745.01; 4/210, DIG. 14, DIG. 19, 286, 287, 288, 289; 137/577, 590, 591, 593

(56) References Cited

U.S. PATENT DOCUMENTS

| | | | | |
|---|---|---|---|---|
| 4,161,043 A | * | 7/1979 | Flores | 277/606 |
| 4,246,925 A | | 1/1981 | Oldfelt | |
| 4,722,154 A | | 2/1988 | Virta et al. | |
| 4,745,712 A | * | 5/1988 | O'Leary | 4/663 |
| 5,050,247 A | * | 9/1991 | Hsu | 4/292 |
| 5,554,285 A | * | 9/1996 | Bellefeuille | 210/449 |
| 6,101,766 A | | 8/2000 | Mogensen | |
| 6,230,337 B1 | * | 5/2001 | Barnett | 4/286 |

FOREIGN PATENT DOCUMENTS

| | | |
|---|---|---|
| DK | 171589 | 2/1997 |
| EP | 0 731 020 | 9/1996 |
| FI | 70960 | 7/1986 |
| FI | 75127 | 1/1988 |
| FI | 951090 | 9/1996 |

* cited by examiner

*Primary Examiner*—Korie Chan
*Assistant Examiner*—Amy J. Sterling
(74) *Attorney, Agent, or Firm*—John Smith-Hill; Smith-Hill and Bedell

(57) ABSTRACT

A waste water collection arrangement for combining the waste water discharge of several different plumbing fixtures includes a water receiving trap having a chamber in which water is received to provide a gas-tight seal. At least two inlet assemblies deliver waste water to the chamber and at least one outlet assembly discharges water from the chamber. The chamber has a lid part through which the inlet assemblies pass at least substantially perpendicular to the lid part. The inlet assemblies are mounted on the lid part so as to be movable as required to desired positions for connection to waste water conduits. The chamber is essentially isolated from the ambient air.

19 Claims, 5 Drawing Sheets

WASTE WATER COLLECTION ARRANGEMENT

BACKGROUND OF THE INVENTION

This invention relates to a waste water collection arrangement for collecting waste water from plumbing fixtures arranged in one or more room units and delivering the waste water to a common collection pipe. In particular, but not exclusively, the room units are cabins in a ship or vessel, although the room units could be provided in another structure, such as a building. The invention is particularly concerned with plumbing fixtures, such as wash basins, showers, baths (including whirlpool baths) and the like having so-called "grey water" waste water discharges. The invention also relates to a structure (a vessel or building) provided with such a waste water collection arrangement and to a method of providing such a waste water collection arrangement in a structure (a vessel or building).

In vessels it is known to provide plumbing fixtures in cabins with separate sanitary traps adjacent to the outlet of each fixture. A portion of the waste water discharged by each fixture is retained in the associated trap forming a water seal which isolates the fixture and the cabin in which it is located from the main drain conduit or pipe. These known water seals or locks require a definite height of liquid column to work properly. Additionally feeding waste outlets from several fixtures to a common drain conduit requires several water locks, which increases investment costs and takes up valuable space. In vessels there is also the possibility that, through non-use of a particular fixture, water in a trap may evaporate causing the water seal in the trap to be broken.

A particular problem in vessels is the need to have different classes of cabins at different levels of a vessel. In order to accommodate water traps or locks of waste water discharge pipes or channels under the floor of a cabin so that they function properly, it is often necessary to raise the floor level of a sanitary cubicle within the cabin so as to be higher than the main floor level of the cabin. However this is not an ideal solution since an inconvenient step is created between the different floor levels of the cabin. Another solution to the problem is to provide a cabin unit with a raised floor and a working or utility space between the base of the cabin unit and the raised floor for the incorporation of the water traps. However for a given vessel height, fewer floor levels and thus fewer cabins can be accommodated. For example, in a modern passenger vessel, decreasing the number of floor levels by one can result in the total number of cabins being reduced by from 250–300, which of course greatly affects the profitability of the vessel.

It is also known in vessels to position cabin units on different floor levels and to position the water traps or seals for cabin units of a particular floor level completely underneath that floor level. However this solution is impractical since it is difficult, if not impossible, to work underneath a floor level both during construction of the vessel and when doing service work.

An aim of the present invention is to provide a totally novel waste water collection arrangement for room units, and in particular, but not exclusively, for cabins of vessels, with which arrangement the problems of known technology are minimized. A further aim of the invention is to achieve an arrangement in which the space utilization for the collection of waste water from plumbing fixtures, in particular those arranged in cabins of a vessel, is minimized.

SUMMARY OF THE INVENTION

According to one aspect of the present invention there is provided a waste water collection arrangement for combining waste water discharges of multiple plumbing fixtures, the arrangement comprising a trap including a lid part having a general plane, the trap defining a chamber for receiving water and the chamber being substantially isolated from surrounding airspace, at least two inlet assemblies which pass through the lid part at least substantially perpendicular to said general plane for delivering waste water to the chamber, and at least one discharge assembly for allowing water to exit from the chamber while retaining water in the chamber to provide a gas-tight seal.

The isolation of the water receiving chamber from the surrounding airspace minimizes evaporation of water from the chamber so that the seal remains in working condition for a relatively long period of time compared with open water traps. The inlet assemblies may be movably mounted to the lid part, which allows the inlet connections to the collection arrangement to be adjusted. Typically the inlet assemblies can be turned into any desired direction to connect to waste water outlets from plumbing fixtures as required. The height of each inlet assembly may also be adjustable.

A waste water collection arrangement according to the present invention enables especially effective use of, and minimization of, space for discharging waste water from room units, in particular cabins of vessels.

Advantageously the collection arrangement comprises a basic part and the lid part which define the water receiving chamber and which are preferably removably fastened to each other in a gas-tight manner. Suitably the inlet assemblies can be reversibly mounted on the lid part with regard to the longitudinal axis of the inlet means.

Advantageously the discharge assembly opens to the chamber (water lock space) a predetermined distance from the bottom of the basic part. The discharge assembly can be led through a side wall of the basic part or in some cases through the bottom of the basic part. Additionally the inlet assembly preferably extends nearer to the bottom of the basic part than an input opening of the discharge assembly.

According to another aspect of the present invention there is provided an accommodation unit having several floor levels and a plurality of room units at each floor level, each room unit having one or more plumbing fixtures with respective waste water outlets, the accommodation unit including a drain conduit leading from one floor level to another, and at least one waste water collection device associated with each floor level, each waste water collection device defining a chamber and including a lid part, at least two inlet assemblies for delivering waste water from said waste water outlets to the chamber, each inlet assembly being at least partly above the floor level to allow waste water to be supplied to the waste water collection device above the floor level, and each inlet assembly being fitted to the lid part and being movably mounted to the lid part to enable its connection direction and position to be selectable, and an outlet assembly below the floor level for enabling waste water to pass from the waste water collection device to the drain conduit below the floor level while retaining water in the chamber to provide a gas-tight seal.

The waste water collection device is advantageously arranged in the floor level of the accommodation unit outside the base area of the room unit and the waste water outlets from the plumbing fixtures are connected to inlet assemblies of the collection device with separate assembly channels. Advantageously waste water connections from two adjacent room units are connected to a common collection device arranged in a common service space between the room units. This provides a comprehensive solution which is advantageous for space utilization, construction and maintenance.

Preferably the accommodation unit is formed in a vessel with the room units being cabins of the vessel.

According to a further aspect of the present invention there is provided a method of constructing an accommodation unit having several floor levels and a plurality of room units arranged at each floor level, each room unit having one or more plumbing fixtures with respective waste water outlets connected to a waste water outlet means, said method comprising providing at least one waste water collection device for each floor level, each waste water collection device comprising a basic part and a lid part associated therewith, installing the basic part of each collection device on the floor level for which the collection device is provided, fitting the lid parts to their associated basic parts whereby each basic part and the associated lid part define a water-receiving chamber providing a water seal, and connecting the waste water outlet means of at least two room units to each collection device.

Advantageously basic parts of different collection devices are provided on each floor level and at the same level for each floor level. Thus the basic parts stay essentially, most preferably totally, at the same level as the floor level. The predetermined positions of the basic parts and the predetermined positions of room units are advantageously determined so that each basic part is at substantially the same distance from the two room units associated therewith.

Preferably the accommodation unit is part of a vessel with the room units being cabins.

Several advantages are achieved by means of the present invention. Firstly, in the case of application to a vessel, for a given number of floor levels the overall height of the vessel is reduced which advantageously affects the location of the vessel's center of gravity. Additionally sanitary cubicles and other spaces of cabins are at the same level which eases movement. The use of a large number of conventional water locks is also avoided by using common collector conduits with water seals or locks.

BRIEF DESCRIPTION OF THE DRAWINGS

Embodiments of the invention will now be described, by way of example only, with particular reference to the accompanying drawings, in which.

DETAILED DESCRIPTION

Figure 1:
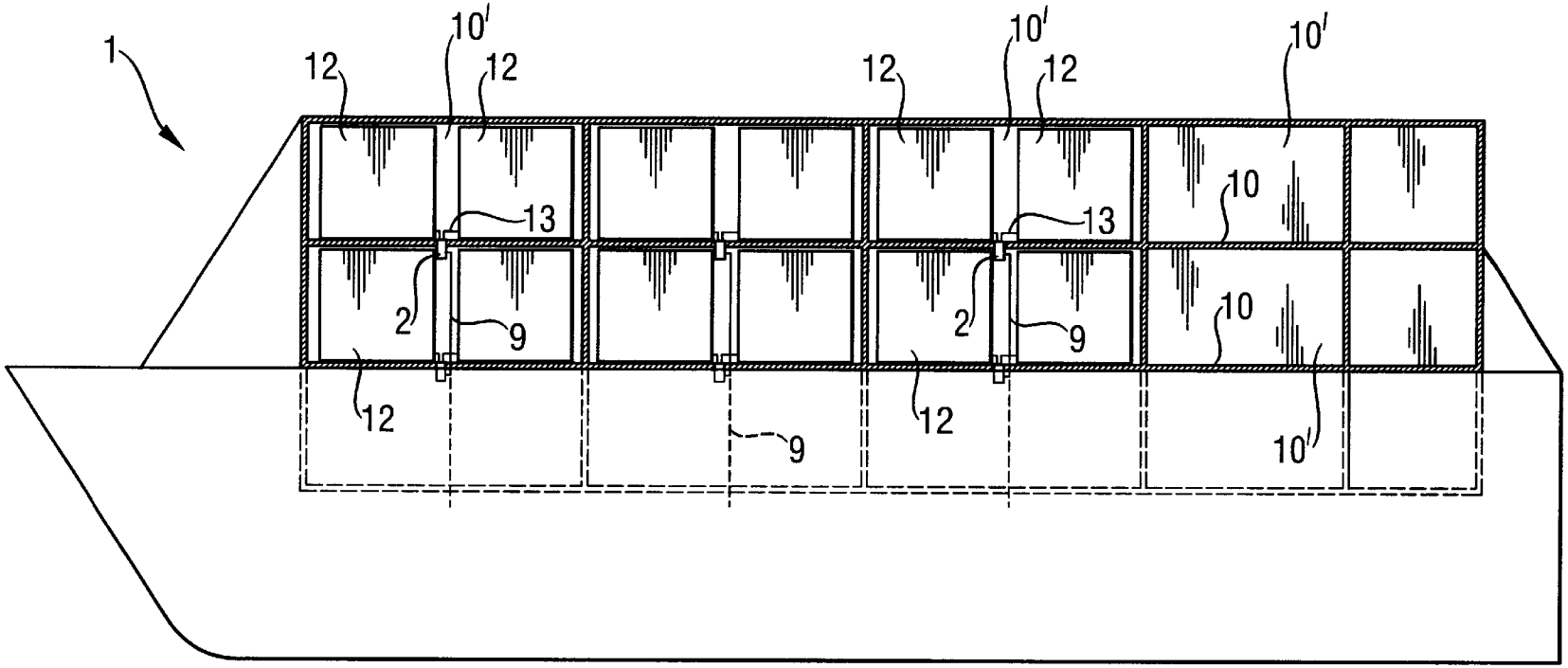
FIG. 1 is a diagrammatic view of an arrangement of cabins and their discharge water channels in a vessel.
Figure 2:
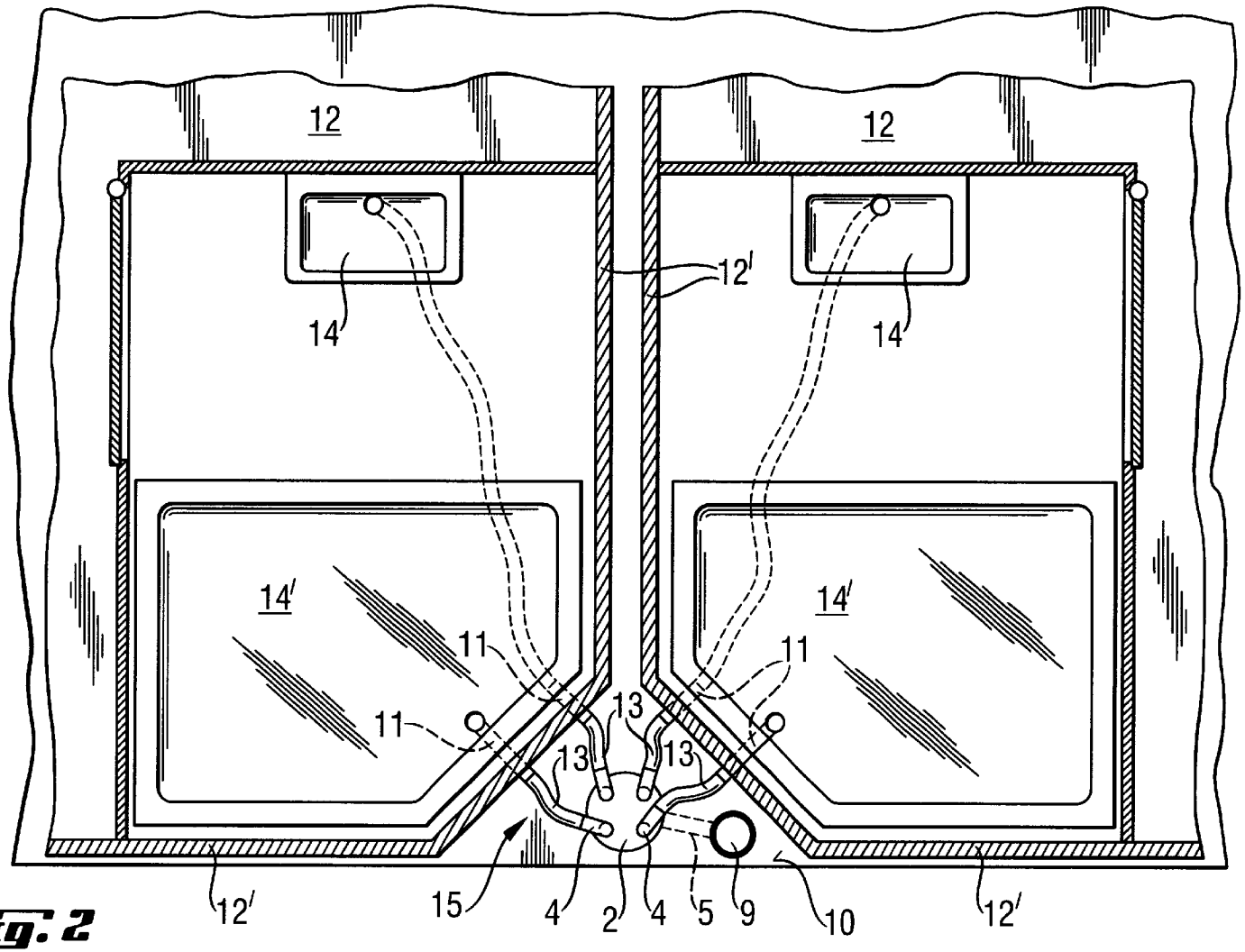
FIG. 2 is a diagrammatic view of an arrangement for supplying waste water from waste water outlets of fixtures to a collector channel in the vessel.

FIG. 1 shows a vessel 1 having a plurality of cabins or the like 12 arranged on several floor levels 10, disposed one above the other, in cabin compartments 10'. The cabins are advantageously prefabricated cabin units which can be placed as required in their correct positions on the floor levels and then connected to the vessel's utility systems, for example the water supply and waste systems and electricity lines. FIG. 2 partly shows two adjacent cabins 12 arranged on one floor level. In order to lead waste water used in a cabin away from the cabin, each cabin is provided with at least one waste water outlet means 11. As shown in FIG. 2, the waste water outlet means 11 may comprise a long tube or pipe extending to an outlet or port at the perimeter of the cabin Waste water outlet pipes from plumbing fixtures, such as basins, showers, bathtubs, whirlpools etc., in a cabin are connected to the waste water outlet means 11 of the cabin (FIG. 2). Waste water is supplied via the outlet means 11 to a number of vertical drain pipes or collector channels 9. It is possible to supply waste water from several cabins on the same floor level 10 to a single collector channel 9 and it is possible for a single collector channel 9 to receive waste water from cabins on multiple floor levels. In particular several waste water outlet means 11 can be connected to a common collector channel 9 via a waste water collection device 2.

FIG. 2 shows in more detail how waste water (i.e. "grey water") from plumbing fixtures is supplied to the collector channel 9. Each cabin unit is equipped with a number of plumbing fixtures, for example a washbasin 14 and a shower. A water outlet pipe (shown in dashed lines in FIG. 2) connects the outlet of the washbasin 14 to one of the waste water outlet means 11. A further waste water outlet means 11 is connected to a shower area 14' of the shower, e.g. a shower tray. In the arrangement shown, the collector channel 9 runs generally vertically between different floor levels. Each floor level has outlet water pipes connected to different collection devices 2 which are connected to the same or different collector channels 9. The collection device 2 allows water discharged from various cabin units 12 to be collected and supplied to the collector channel 9 whilst providing a water lock or seal separating gas spaces of the various pipes and channels. Thus the waste water outlet means 11 of a cabin 12 are collectively fed to the collection device 2 via inlet assemblies or fittings 4 using connecting pipes or channels 13 positioned above the floor level 10. The collection device 2 has a chamber or water lock space 3 (see FIG. 3) with several waste water inlet assemblies 4 for supplying waste water to the chamber 3. If the collection device is arranged between two cabins 12, each having two waste water outlet means 11, there will be four inlet assemblies 4. The collection device 2 is connected to the collector channel 9 by piping arranged below the floor level 10.

In this manner an advantageous cabin arrangement is achieved with an efficient discharge water collection from plumbing fixtures using a water lock or seal which does not require the height between floor levels to be increased to accommodate a utility space or for the floors of the cabins to be needlessly raised. In the preferred construction illustrated, each inlet assembly 4 has a vertical segment slidably and/or turnably mounted in the lid part 7 and a horizontal inlet segment for connection to the waste water outlet means 11. The inlet assemblies 4 for the incoming waste water from the plumbing fixtures are adjustably positioned in their mountings on the lid part 7 so that they can be adjustably positioned, e.g. turnably, with regard to their direction of connection to the connecting pipes 13. Additionally the inlet assemblies 4 may be mounted so as to be movably adjusted, e.g. slidable, up and down for adjusting the height of the horizontal inlet segment. In this way the discharged waste water from the plumbing fixtures flows from each point of use, such as the shower area 14', to the common collection device 2, where several discharged waste water flows are combined in a single flow which forms a common water lock to each point of use. From the common collection device 2, the waste water flows out to the collector channel 9.

The spatial extent of each cabin is determined by its base area 12'. Each cabin unit is generally rectangular in horizontal section. However, one corner of the generally rectangular section is bevelled, thereby locally decreasing the base area relative to the rectangular section, so that between the base areas 12' of a pair of adjacent cabins 12 there is a common or shared service space 15. In this manner the service space 15 is inside the effective floor or footprint area taken by these two cabins and additional space is not required. The collection device 2 is arranged in the floor level 10 of the vessel in the service space 15, i.e. outside the actual base area 12' of the cabins 12, and the waste water outlet means 11 of the two cabins are connected to the single collection device 2 which is arranged in the common service space 15.

Figure 3:
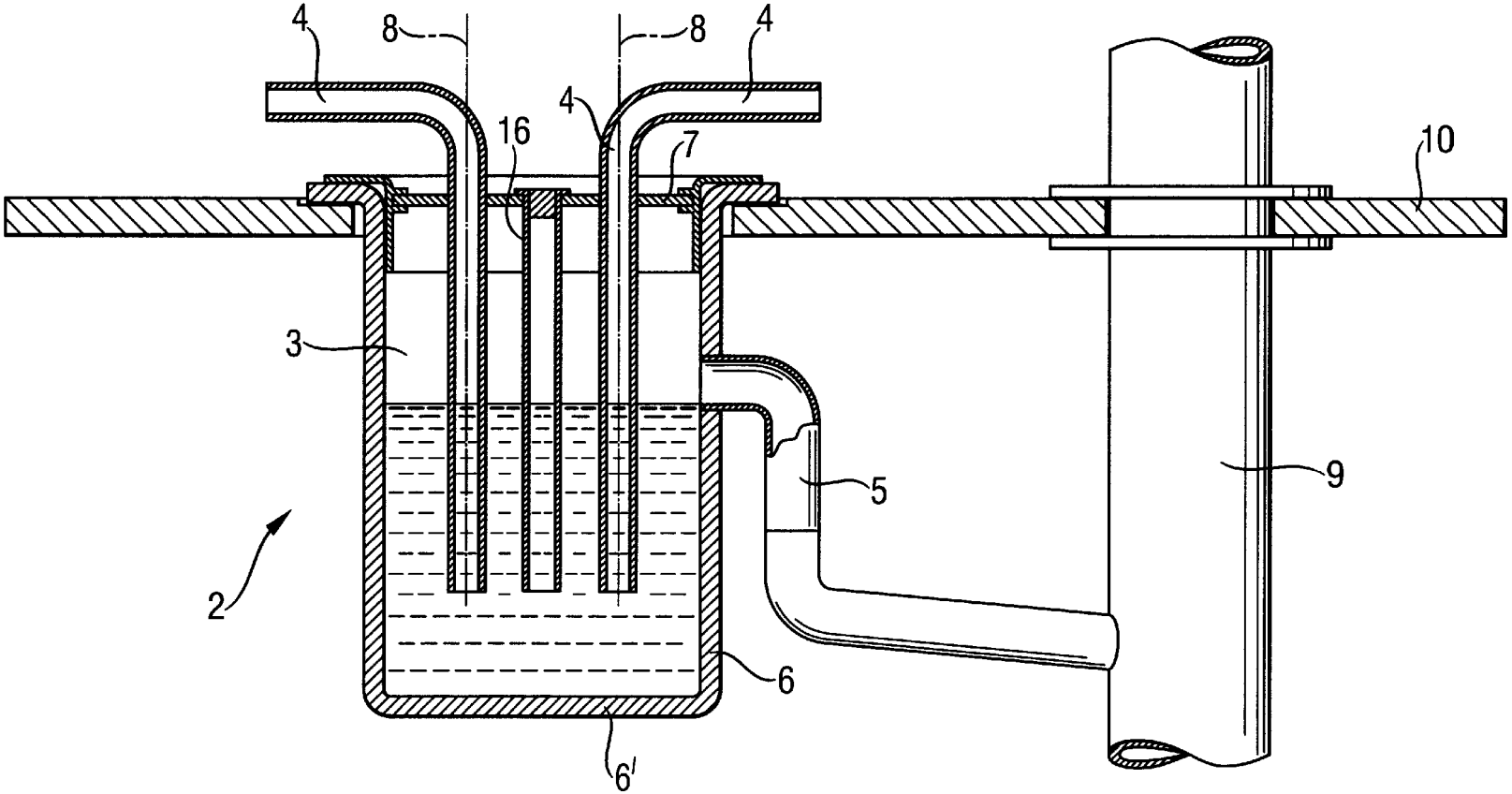
FIG. 3 is a diagrammatic view of an embodiment of a collection device for waste water discharged from plumbing fixtures.
Figure 4:
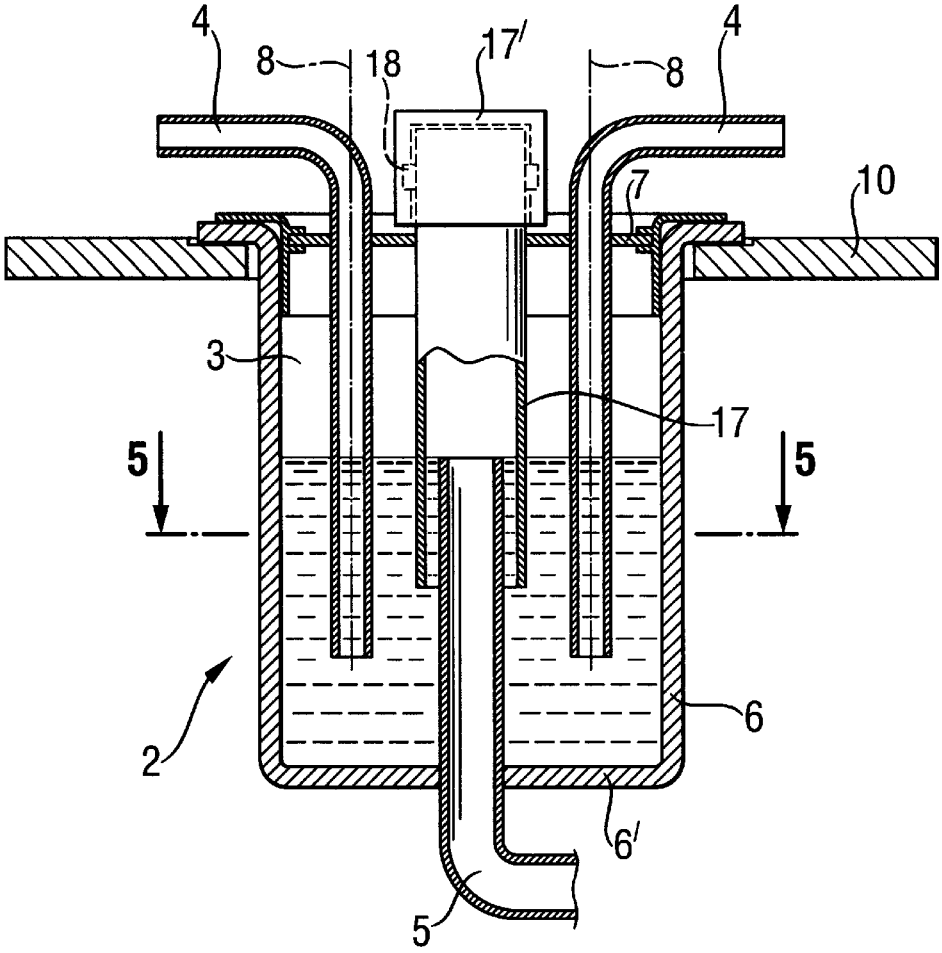
FIG. 4 is a diagrammatic view of another embodiment of a collection device for waste water discharged from plumbing fixtures.
Figure 6:
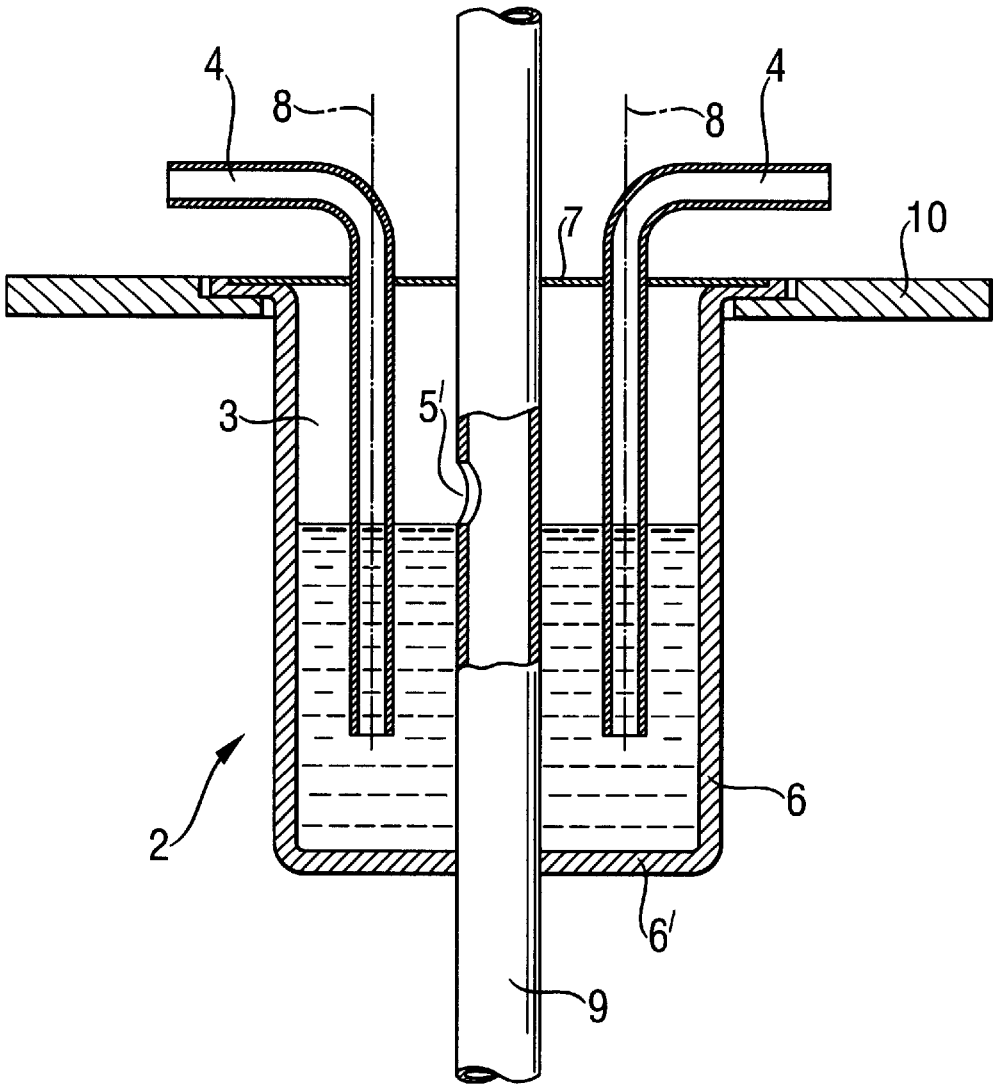
FIG. 6 is a diagrammatic view of a third embodiment of a collection device for waste water discharged from plumbing fixtures.

FIGS. 3, 4 and 6 show different embodiments of the collection device 2 for receiving waste water discharged from plumbing fixtures. A common feature of the several embodiments is that each collection device 2 defines a generally cylindrical space or chamber 3 which is substantially vertical and provides a water lock or seal forming a gas-tight seal. The chamber 3 is defined by a basic part 6 closed by a lid part 7. As shown the lid part 7 is flat and disposed horizontally. Several water inlet assemblies or inlet fittings 4 extend into the chamber 3 with their lower ends immersed in water contained in the chamber 3. Each inlet fitting has a vertical segment that extends slidingly through the lid part 7 and is disposed substantially perpendicular to the lid part. By virtue of the vertical segment extending slidingly through the lid part, the inlet fittings 4 can be positioned as required relative to the collection device. Thus, by turning about the axis 8 of the vertical segment, the inlet fitting 4 can be oriented in the required direction for connection to the respective connection pipes 13. Further, the inlet fitting 4 is slidable vertically relative to the lid part 7, and this allows the horizontal segment to be raised or lowered somewhat, as required to accommodate the height of the waste water outlet means. In addition the lid part 7 is suitably arranged so that it is substantially at the same vertical height as the floor level 10 in which the collection device 2 is mounted. This means that the basic part 6 is positioned so as to extend below the floor level 10. By this arrangement the joining direction can be chosen always according to the situation, which eliminates the need to have harmful serpentine courses or paths for the inlet fittings. Furthermore, the inlet opening of the fitting 4 is close to the surface of the floor level 10. This is important, especially in connection with vessels, since available height differences are obtained without sacrificing vertical space, in other words the height difference over the length of the coupled conduits, e.g. 11 and 13, is mainly always kept to a minimum.

In addition the water lock chamber 3 of the collection device 2 is essentially closed from ambient air by virtue of the joint or connection of the lid part 7 to the basic part 6 being gas-tight. Thus even if the device is not used for a long time period, substantial evaporation of water contained in the chamber 3 does not take place and accordingly the water lock or seal of the collection device 2 remains functional. To make maintenance possible, the basic part 6 and the lid part 7 are preferably detachably fastened to each other. However it is also possible for the lid part 7 to be permanently fastened, e.g. welded, to the basic part 6. The parts 6 and 7 can be prefabricated outside the vessel.

The collection device 2 comprises at least one discharge outlet assembly or outlet fitting 5 for waste water exiting from the water lock chamber 3. The water lock chamber 3 opens to the discharge outlet assembly 5 via an opening at a predetermined height above the bottom 6' of the basic part. Correspondingly the incoming inlet fittings 4 extend downwardly to a position such that their outlets are located nearer the bottom 6' of the basic part than the opening to the discharge outlet assembly 5, i.e. below the opening to the discharge outlet assembly 5.

Figure 5:
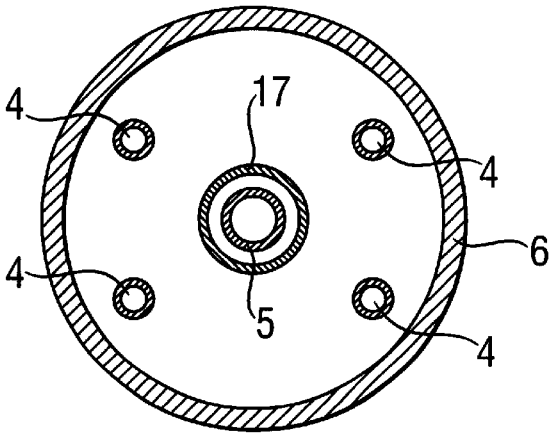
FIG. 5 is a section taken on the line 5—5 of FIG. 4.

The discharge outlet assembly 5 can pass depending on the case through the side wall of the basic part 6 as shown in FIG. 3, or through the bottom 6' of the basic part as shown in FIG. 4. As can be seen from FIG. 3, the collection device 2 is advantageously equipped with a pipe 16, which is openable, for example by removing a plug, to provide communication between the water lock chamber 3 and the service space 15. In this way any water present in the service space 15 can be drained to the chamber 3 via the pipe 16. In this embodiment the lid part 7, the inlet fittings 4 and the pipe 16 extending beneath the free surface of the water lock are exposed to the gases of the collector channel 9. Thus, should the lid part leak or be removed, the gases can escape into the service space 15. In FIG. 4 an embodiment is shown wherein the lid part 7 is not exposed to the gases of the collector channel 9. In FIG. 5, which is a section taken on the line 5—5 of FIG. 4, it can be seen that the discharge outlet assembly 5 is arranged inside a second chamber defined by a pipe 17. This pipe 17 penetrates or extends through the lid part 7 and is provided with an upper checking hatch 17' for the lid part 7 through which, among other things, the discharge outlet assembly 5 can be cleaned. The checking hatch 17' should be at least substantially gas-tight to prevent odors from spreading or escaping to the cabins. For this reason a gasket 18 is provided.

FIG. 6 shows a similar device 2 to those described previously but in which the collector channel 9 passes through the water lock chamber 3. With this design the area of the service space 15 at the floor level 10 stays free as far as possible. In this design the discharge outlet assembly 5 suitably comprises at least one opening 5' in the wall of the collector channel 9.

The invention has been described above with reference to specific embodiments but it is clear that technical solutions mentioned are only by way of example. The invention is not limited to the shown embodiments, but several modifications are feasible within the scope of the attached claims.

What is claimed is:

1. A waste water collection arrangement for combining waste water discharges of multiple plumbing fixtures, the arrangement comprising:

a trap including a lid part having a general plane, the trap defining a chamber for receiving water and the chamber being substantially isolated from surrounding airspace, at least two inlet assemblies which pass through the lid part at least substantially perpendicular to said general plane for delivering waste water to the chamber, and at least one discharge assembly for allowing water to exit from the chamber while retaining water in the chamber to provide a gas-tight seal, and wherein the trap includes a basic part having walls that bound the chamber and extend transversely of the general plane of the lid part, the lid part is removably fastened to the basic part, and the inlet assemblies are fitted to the lid part.

2. A waste water collection arrangement according to claim 1, wherein each inlet assembly is replaceably mounted in the lid part with regard to a longitudinal axis of the inlet assembly.

3. A waste water collection arrangement according to claim 1, wherein the lid part is fastened in a gas tight manner to the basic part.

4. A waste water collection arrangement according to claim 1, wherein the basic part has a bottom and the chamber opens to the discharge assembly a predetermined distance from the bottom of the basic part.

5. A waste water collection arrangement according to claim 4, wherein the discharge assembly passes through the bottom of the basic part.

6. A waste water collection arrangement according to claim 4, wherein the discharge assembly passes through a side wall of the basic part.

7. A waste water collection arrangement according to claim 4, wherein at least one of said inlet assemblies has an output opening closer to the bottom of the basic part than the opening from the chamber to the discharge assembly.

8. A waste water collection arrangement according to claim 1, wherein each inlet assembly is turnably mounted in the lid part.

9. A waste water collection arrangement according to claim 1, wherein each inlet assembly is mounted in the lid part so as to be vertically adjustable with respect thereto.

10. An accommodation unit having several floor levels and a plurality of room units at each floor level, each room unit having one or more plumbing fixtures with respective waste water outlets, the accommodation unit including a drain conduit leading from one floor level to another, and at least one waste water collection device associated with each floor level, each waste water collection device defining a chamber and including:

a lid part, at least two inlet assemblies for delivering waste water from said waste water outlets to the chamber, each inlet assembly being at least partly above the floor level to allow waste water to be supplied to the waste water collection device above the floor level, and each inlet assembly being fitted to the lid part and being movably mounted to the lid part to enable its connection direction and position to be selectable, and an outlet assembly below the floor level for enabling waste water to pass from the waste water collection device to the drain conduit below the floor level while retaining water in the chamber to provide a gas-tight seal, and wherein each waste water collection device is mounted in a floor level and the lid part of each collection device is at substantially the same height as the floor level in which the collection device is mounted.

11. An accommodation unit according to claim 10, wherein each collection device comprises a basic part which, together with the lid part, defines said chamber, the basic part and the lid part are detachably fastened to each other, and the basic part is fastened to one of the floor levels so that it extends below the floor level.

12. An accommodation unit according to claim 11, wherein the chamber opens to the outlet assembly through an input opening at a predetermined distance from the bottom of the basic part, and the inlet assemblies are located nearer the bottom of the basic part than said input opening.

13. An accommodation unit having several floor levels and a plurality of room units at each floor level, each room unit having one or more plumbing fixtures with respective waste water outlets, the accommodation unit including a drain conduit leading from one floor level to another, and at least one waste water collection device associated with each floor level, each waste water collection device defining a chamber and including:

a lid part, at least two inlet assemblies for delivering waste water from said waste water outlets to the chamber, each inlet assembly being at least partly above the floor level to allow waste water to be supplied to the waste water collection device above the floor level, and each inlet assembly being fitted to the lid part and being movably mounted to the lid part to enable its connection direction and position to be selectable, and an outlet assembly below the floor level for enabling waste water to pass from the waste water collection device to the drain conduit below the floor level while retaining water in the chamber to provide a gas-tight seal, and wherein each room unit has a base area, each collection device associated with a floor level is arranged outside the base area of the room units on that floor level, and waste water discharge outlets associated with the room units are connected to the inlet assemblies of the collection device by respective connection channels.

14. An accommodation unit according to claim 13, wherein waste water discharge outlets of two room units on a given floor level are connected to one collection device and the collection device is arranged in a common service space for the two room units.

15. A vessel having an accommodation unit according to claim 10.

16. An accommodation unit according to claim 13, wherein each collection device comprises a basic part which, together with the lid part, defines said chamber, the basic part and the lid part are detachably fastened to each other, and the basic part is fastened to one of the floor levels so that it extends below the floor level.

17. An accommodation unit according to claim 16, wherein the chamber opens to the outlet assembly through an input opening at a predetermined distance from the bottom of the basic part, and the inlet assemblies are located nearer the bottom of the basic part than said input opening.

18. An accommodation unit according to claim 13, wherein each waste water collection device is mounted in a floor level and the lid part of each collection device is at substantially the same height as the floor level in which the collection device is mounted.

19. A vessel having an accommodation unit according to claim 13.

* * * * *